US009759044B2

(12) United States Patent
Castro

(10) Patent No.: US 9,759,044 B2
(45) Date of Patent: Sep. 12, 2017

(54) REVOLVING BALL SEAT FOR HYDRAULICALLY ACTUATING TOOLS

(71) Applicant: Weatherford/Lamb, Inc., Houston, TX (US)

(72) Inventor: Candido Castro, Houston, TX (US)

(73) Assignee: Weatherford Technology Holdings, LLC, Houston, TX (US)

( * ) Notice: Subject to any disclaimer, the term of this patent is extended or adjusted under 35 U.S.C. 154(b) by 518 days.

(21) Appl. No.: 14/444,470

(22) Filed: Jul. 28, 2014

(65) Prior Publication Data

US 2016/0024872 A1 Jan. 28, 2016

(51) Int. Cl.
*E21B 33/12* (2006.01)
*E21B 41/00* (2006.01)

(52) U.S. Cl.
CPC ..... *E21B 41/00* (2013.01)

(58) Field of Classification Search
CPC .... E21B 34/14; E21B 41/00; E21B 2034/002; E21B 23/00; E21B 34/06; E21B 34/12
See application file for complete search history.

(56) References Cited

U.S. PATENT DOCUMENTS 4,254,836 A 3/1981 Russell
4,871,019 A * 10/1989 Haley ..... E21B 34/14 166/167
5,553,672 A 9/1996 Smith, Jr. et al.
6,866,100 B2 3/2005 Gudmestad et al.
6,920,930 B2 7/2005 Allamon et al.
7,921,922 B2 * 4/2011 Darnell ..... E21B 23/04 166/168
8,074,718 B2 12/2011 Roberts
8,181,701 B2 * 5/2012 Yokley ..... E21B 23/04 166/192
8,397,823 B2 * 3/2013 Xu ..... E21B 23/00 166/318
8,418,769 B2 * 4/2013 Fay ..... E21B 23/04 166/194
8,479,808 B2 * 7/2013 Gouthaman ..... E21B 33/1285 166/156
8,739,864 B2 * 6/2014 Crider ..... E21B 34/14 166/240
9,316,084 B2 * 4/2016 Carter ..... E21B 33/128
2007/0272420 A1 11/2007 Reimert et al.
2008/0223581 A1 9/2008 Beall et al.
2010/0084146 A1 4/2010 Roberts
2011/0088906 A1 4/2011 Myerley
2011/0174505 A1 7/2011 Gill et al.
2011/0192607 A1 8/2011 Hofman et al.
2013/0248201 A1 9/2013 Jackson
(Continued)

*Primary Examiner* — Daniel P Stephenson
(74) *Attorney, Agent, or Firm* — Blank Rome LLP

(57) ABSTRACT

A downhole tool has a housing, a piston, and a seat and is for use with a deployed plug or ball and applied fluid pressure. The housing defines a bore, and the piston is disposed in the bore of the housing and is biased to move from a first position to a second position. The seat is also disposed in the bore of the housing and is operably connected to the piston. The seat rotates from a first orientation for engaging the deployed plug to a second orientation for passing the deployed plug in response to movement of the piston from the first position near the seat to the second position away from the seat.

41 Claims, 8 Drawing Sheets

(56) References Cited

U.S. PATENT DOCUMENTS

2013/0327519 A1* 12/2013 Ibarra ..... E21B 23/006
166/250.01
2016/0024872 A1* 1/2016 Castro ..... E21B 41/00
166/386

* cited by examiner

REVOLVING BALL SEAT FOR HYDRAULICALLY ACTUATING TOOLS

BACKGROUND OF THE DISCLOSURE

In the completion of oil and gas wells, downhole tools are mounted on a workstring, such as a drill string, a landing string, a completion string, or a production string. The workstring can be any type of wellbore tubular, such as casing, liner, tubing, and the like. A common operation performed downhole temporarily obstructs the flow path within the wellbore to allow the internal pressure within a section of the workstring to be increased. In turn, the increased pressure operates hydraulically actuated tools. For example, a liner hanger can be hydraulically operated to hang a liner in the well's casing.

Sealably landing a ball on a ball seat provides a common way to temporarily block the flow path through the wellbore tubular so a hydraulic tool above the seat can be operated by an increase in pressure. Historically, segmented dogs or keys have been used create the ball seat for landing the ball. Segmented ball seats may be prone to fluid leakage and tend to require high pump rates to shear open the ball seat. Additionally, the segmented ball seat does not typically open to the full inner diameter of the downhole tubular so the ball seat may eventually need to be milled out with a milling operation.

Alternatively, a hydro-trip mechanism can use collet fingers that deflect and create a ball seat for engaging the dropped ball. In this type of ball seat, the collet-style mechanism opens up in a radial direction when shifted past a larger diameter groove. However, the collet-style ball seat is more prone to leaking than solid ball seats, and the open collet fingers exposed inside the tubular create the potential for damaging equipment used in subsequent wellbore operations.

Any of the hydraulic tools that are to be actuated and are located above the ball seat need to operate at a pressure below whatever pressure is needed to eventually open or release the ball seat. Internal pressures can become quite high when breaking circulation or circulating a liner through a tight section. To avoid premature operation of the tool at these times, the pressure required to open or to release a ball seat needs to be high enough to allow for a sufficiently high activation pressure for the tool. For example, ball seats can be assembled to open or release at a predetermined pressure that can exceed 3000 psi.

Once the hydraulically-actuated tool, such as a liner hanger or packer is actuated, operators want to remove the obstruction in the tubular's flow path. Since the ball seat is a restriction in the wellbore, it must be opened up, moved out of the way, or located low enough in the well to not interfere with subsequent operations. For example, operators will want to move the ball and seat out of the way. Various ways can be used to reopen the tubular to fluid flow.

Commonly, the ball seat is moved out of the way by having it drop downhole. For example, with the ball landed on the seat, the increasing pressure above the ball seat can eventually cause a shearable member holding the ball seat to shear, releasing the ball seat to move downhole with the ball. However, this leaves the ball and ball seat in the wellbore, potentially causing problems for subsequent operations. Additionally, this may require the removal of both the ball and ball seat at a later time.

In another way to reopen fluid flow through the tubular, increased pressure above the ball seat can eventually force the ball to deformably open the seat, which then allows the ball to pass through. In these designs, the outer diameter of the ball represents a maximum size of the opening that can be created through the ball seat. This potentially limits the size of subsequent equipment that can pass freely through the ball seat and further downhole without the risk of damage or obstruction.

Ball seats may also be milled out of the tubular to reopen the flow path. For example, ball seats made of soft metals, such as aluminum or cast iron, are easier to mill out; however, they may not properly seat the ball due to erosion caused by high volumes of drilling mud being pumped through the reduced diameter of the ball seat. Also, if additional landings are to be made, interference from the first ball seat being released downhole may also prevent the ball from sealably landing on another ball seat below.

The subject matter of the present disclosure is directed to overcoming, or at least reducing the effects of, one or more of the problems set forth above.

SUMMARY OF THE DISCLOSURE

A downhole apparatus or tool for use with a deployed plug and applied fluid pressure has a housing, a piston, and a seat. The housing defines a bore, and the piston is disposed in the bore of the housing and is biased to move from a first position to a second position. The piston in the first position is near the seat, while the piston in the second position is away from the seat.

The seat is disposed in the bore of the housing and is operably connected to the piston. In particular, in response to movement of the piston from the first position near the seat to the second position away from the seat, the seat is rotatable from a first orientation for engaging the deployed plug to a second orientation for passing the deployed plug. The seat in the first orientation with the deployed plug engaged therein can capture at least some of the applied fluid pressure, which can then be used for various operations purposes.

In one example of the tool, the piston can have an operable connection to the seat, and the operable connection can transfer axial movement of the piston away from the seat to rotational movement of the seat. The axial movement of the piston can result from mechanical bias from a biasing member or spring instead of hydraulic fluid pressure.

The operable connection can include a linkage operably coupled between the piston and the seat, where the linkage on the piston moved from the first position toward the seat to the second position away from the seat rotates the seat from the first orientation to the second orientation.

In use, when the seat engages the deployed plug, the seat and plug hold the applied fluid pressure in the bore of the housing. This applied fluid pressure can then be used to actuate the tool or to actuate another tool disposed on a toolstring uphole of the tool.

A connection at least temporarily holds the seat axially in the bore of the housing. The connection eventually releases the seat in response to the applied fluid pressure communicated in the bore against the deployed plug engaged in the seat in the first orientation. After the seat has moved axially in the bore once released, the seat has a lock holding the seat axially in the bore of the housing.

After the piston and seat have moved in the housing and the applied fluid pressure has achieved its purposes (i.e., actuating the tool or another tool), the piston moves from the first position near the seat to the second position away from the seat in response to a reduction of the applied fluid pressure. For example, at least one biasing member, such as a spring disposed in the bore, can bias the piston toward the second position away from the seat. The movement of the piston away from the seat rotates the seat from the first orientation via the operable connection to the second orientation so the deployed plug can pass.

In one configuration, the tool is positionable on a toolstring. A second tool is positionable on the toolstring uphole of the first tool and is actuatable with the applied fluid pressure captured in the toolstring against the deployed plug engaged in the seat.

In another configuration, the tool can be a hydraulically-actuated tool, a sliding sleeve, a packer, and a liner hanger. For example, the tool can have a tool body with a main bore in which the housing is movably disposed. The tool body can define a port communicating outside the main bore, and the housing can be movable in the tool body relative to the port. A connection can at least temporarily hold the housing in the main bore of the tool body so that applied fluid pressure against the deployed plug in the seat may be required to shift the housing open relative to the port. For a sliding sleeve, this port in the tool body can be an external port for communicating fluid outside the tool. For a packer, liner hanger, or the like, the port can communicate with a piston or other hydraulic mechanism.

In a method of operating a downhole tool with a deployed plug and applied fluid pressure, the deployed plug engages in a seat rotated in a first orientation in a bore of the tool. Engaging the deployed plug in the seat rotated in the first orientation can involve actuating the tool or another tool in response to the applied fluid pressure against the deployed plug engaged in the seat. To actuate the tool, for example, a sleeve can be shifted relative to an external flow port in the tool. To actuate the other tool, for example, at least one of a hydraulically-actuated tool, a sliding sleeve, a packer, and a liner hanger can be actuated with the applied fluid pressure.

Eventually, the seat engaging the deployed plug and a piston coupled to the seat can move in response to the applied fluid pressure. For example, moving the seat and the piston can involve releasing a temporary hold of the seat and the piston in response to the applied fluid pressure.

The piston then moves away from the seat in response to a subsequent reduction of the applied fluid pressure. To move the piston away from the seat, the seat can lock axially in the tool, and the piston can be biased in a direction away from the seat. In response to the movement of the piston away from the seat, the seat rotates from the first orientation to a second orientation, and the engaged plug is released from the seat bore in response to the rotation of the seat to the second orientation.

In one embodiment, the seat can have a first section of a catch member aligned with the piston and having the seat rotatably supported thereon. The seat can also have a second section of the catch aligned with the piston and having the seat rotatably supported thereon. The first and second sections can be cylindrical bodies or sleeves.

The first section can have at least one segment rotatably connected to a rotation point on the seat. The second section can include a connection at least temporarily holding the seat axially in the bore of the housing. The connection can release the seat to move axially in response to fluid pressure communicated in the bore against the deployed plug engaged in the seat while in the first orientation. The second section can also include a lock holding the seat axially in the bore of the housing after the seat has moved axially in the bore once released.

In another embodiment, the piston can have a first sleeve disposed in the bore of the housing and defining a first axial bore therethrough. The seat can have a second sleeve of a catch member and a rotatable body. The second sleeve can define a second axial bore therethrough in line with the first axial bore of the piston. The body of the seat can be rotatably supported on the second sleeve.

The body can have a first passage with an opening for entry of the deployed ball from the second axial bore and with an opposite seat profile for engaging the deployed ball. The body can also have a second passage offset from the first passage and aligning with the second axial bore when the seat has the second orientation. The second passage can define an equivalent inner dimension to the second axial bore, and the second axial bore can define an equivalent inner dimension to the first axial bore.

The foregoing summary is not intended to summarize each potential embodiment or every aspect of the present disclosure.

DETAILED DESCRIPTION OF THE DISCLOSURE

Figure 1:
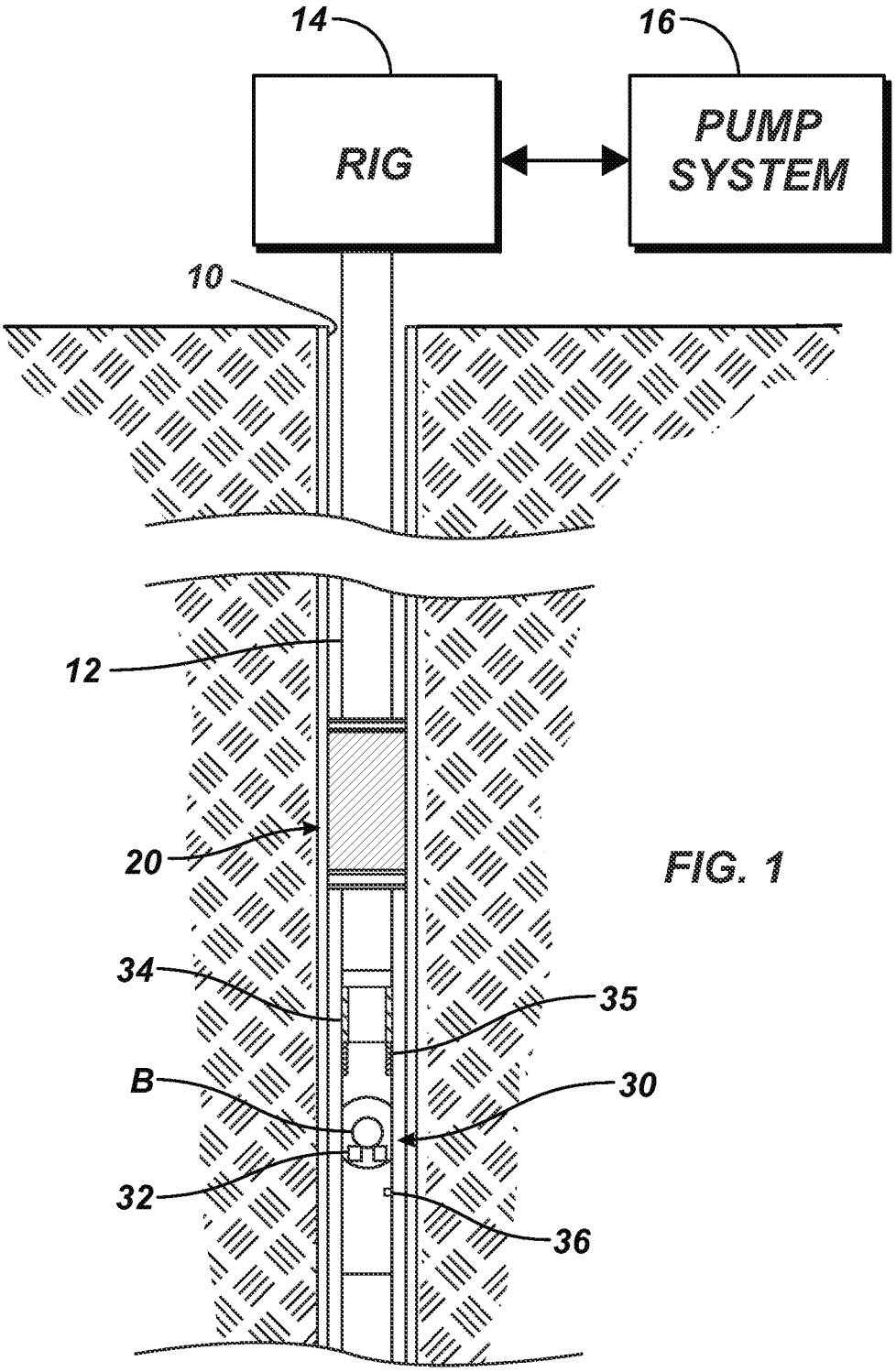
FIG. 1 illustrates a wellbore assembly having a revolving ball seat for actuating a hydraulically actuated tool.

FIG. 1 illustrates a wellbore tubular 12 disposed in a wellbore 10. A hydraulically-actuated tool 20, such as a packer, a liner hanger, or the like, is disposed along the wellbore tubular 12 uphole from a downhole tool 30. The disclosed downhole tool 30 can be used to set the hydraulically-actuated tool 20 and has a rotating revolving ball seat 32 that allows a setting ball, plug, or other deployed device B to selectively land and then pass therethrough.

When operators wish to actuate the hydraulically-actuated tool 20, for instance, an appropriately sized ball B is dropped from the rig 14 to engage in the revolving ball seat 32 of the downhole tool 30. With the ball B engaged in the seat 32, operators use the pumping system 16 to increase the fluid pressure in the wellbore tubular 12 uphole from the tool 30. In turn, the increased tubing pressure actuates an appropriate mechanism in the hydraulically-actuated tool 20 uphole of the revolving ball seat 32. For example, the tool 20 may be a hydraulically-set packer that has a piston that compresses a packing element in response to the increased tubing pressure.

Once the tool 20 is actuated, operators will want to reopen fluid communication downhole by moving the seated ball B out of the way. Rather than milling out the ball B and seat 32 or shearing the ball B and seat 32 out of the way with increased pressure, the revolving ball seat 32 of the present disclosure allows operators to open the revolving seat 32 and pass the ball B by rotating the seat 32.

Rather than using translated motion, the revolving ball seat 32 uses rotation to let the ball B pass the seat 32. For example, the ball B lands on the seat 32, and pressure is increased so the ball seat 32 moves downward linearly. This movement compresses a biasing member 35 while simultaneously shifting a piston 34 downward. The seat 32 moves downward and locks in place with a lock 36. With the seat 32 locked in place, fluid can bypass the seat 32 to equalize the pressure above and below the seat 32, although pressure equalization is not strictly required to release the ball B.

Figures 2A, 2B, 2C:
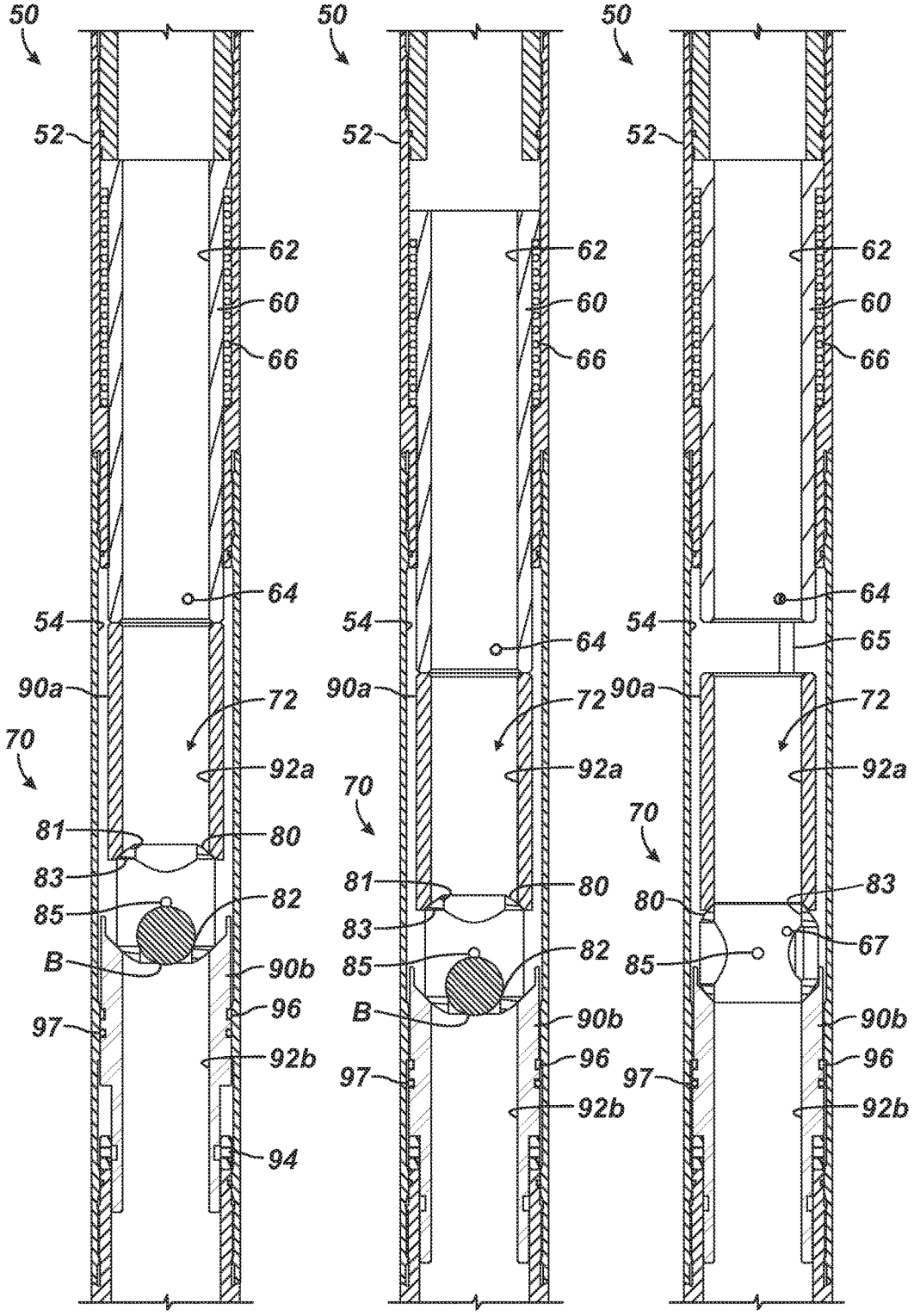
FIG. 2A illustrates a cross-sectional view of a downhole tool having a revolving ball seat according to the present disclosure in a run-in condition.
FIG. 2B illustrates a cross-sectional view of the downhole tool having the revolving ball seat in an intermediate condition with the ball seat sheared free.
FIG. 2C illustrates a cross-sectional view of the downhole tool having the ball released from the revolving ball seat in an actuated condition.

To release the ball B, tubing pressure is diminished. The piston 34 moves away from the seat 32 by the biasing member 35, and the ball seat 32 rotates to pass the ball B. As the ball B is released, the seat 32 does not lift up the hydrostatic fluid above the seat 32. Turning now to more details of a downhole tool having a revolving ball seat, FIG. 2A illustrates a cross-sectional view of a downhole tool 50 having a revolving ball seat 80 in a run-in condition. FIG. 2B illustrates a cross-sectional view of the downhole tool 50 having the revolving ball seat 80 in an intermediate condition with the ball seat 80 sheared free, and FIG. 2C illustrates a cross-sectional view of the downhole tool 50 having the ball released from the revolving ball seat 80 in an actuated condition.

The tool 50 includes an outer housing 52, which couples to sections of wellbore tubular (not shown) in a conventional manner, by threads, couplings, or the like. The housing 52 itself may comprises several tubular components to facilitate assembly. Inside a bore 54 of the housing 52, the tool 50 has a piston 60 and a catch 70 temporarily fixed in the housing 52 in the run-in condition with one or more temporary connections 94, such as shear pins.

The piston 60 is a sleeve disposed in the bore 54 of the housing 52 and defines a first axial bore 62 therethrough. The axial bore 62 allows for passage of the deployed ball B to the catch 70, but the bore 62 also acts as the main tubular bore for the tool 50 and is suitably sized as such.

The piston 60 is biased to move from a first position (FIGS. 2A-2B) to a second position (FIG. 2C). These positions are relative to the catch 70 and not necessarily relative to the housing 52, as will be apparent below. At least one biasing member, such as spring 66, disposed in the bore 54 can bias the piston 60 toward the second position (e.g., away from the catch 70). For example, a head on the piston 60 can engage against an end of the spring 66—the other end of which engages inside the housing 52 (e.g., against an internal shoulder in the inner bore 54).

The catch 70 disposed in the bore 54 of the housing 52 defines a second axial bore 72 therethrough in line with the first axial bore 62 of the piston 60. This second bore 72 also acts as the main tubular bore for the tool 50 and is appropriately sized.

The catch 70 has the revolving ball seat 80 disposed thereon. The seat 80 is operably connected to the piston 60 and is rotatable from a first orientation (FIGS. 2A-2B) to a second orientation (FIG. 2C). As will be described below, rotation of the seat 80 is in response to movement of the piston 60 from the first position (e.g., near the catch 70 as in FIG. 2B) to the second position (e.g., distanced from the catch 70 as in FIG. 2C). The seat 80 in the first orientation (FIGS. 2A-2B) can engage the deployed plug or ball B, while the seat 80 in the second orientation (FIG. 2C) can pass the deployed ball B further on through the tool 50.

As shown in FIG. 2A, the piston 60 in the first position is disposed toward the catch 70. This is also true for FIG. 2B when the piston 60 and catch 70 are moved axially in the housing 52 by the communicated fluid pressure against the seated plug breaking the temporary connections 94. As shown in FIG. 2C, the piston 60 in the second position is disposed away from the catch 70, and an operable connection 65 on the piston 60 rotates the seat 80 from the first orientation (FIG. 2B) to the second orientation (FIG. 2C).

As shown more particularly, the catch 70 includes an upper mandrel or section 90*a* and a lower mandrel or section 90*b* with the revolving seat 80 disposed therebetween. Fitting in a space between the distal ends of the two mandrels 90*a-b*, sealing members (not shown), such as sealing rings or the like, can be used between the sections' ends and the outer surface of the seat 80 to maintain fluid isolation therebetween, if necessary.

Figure 3A:
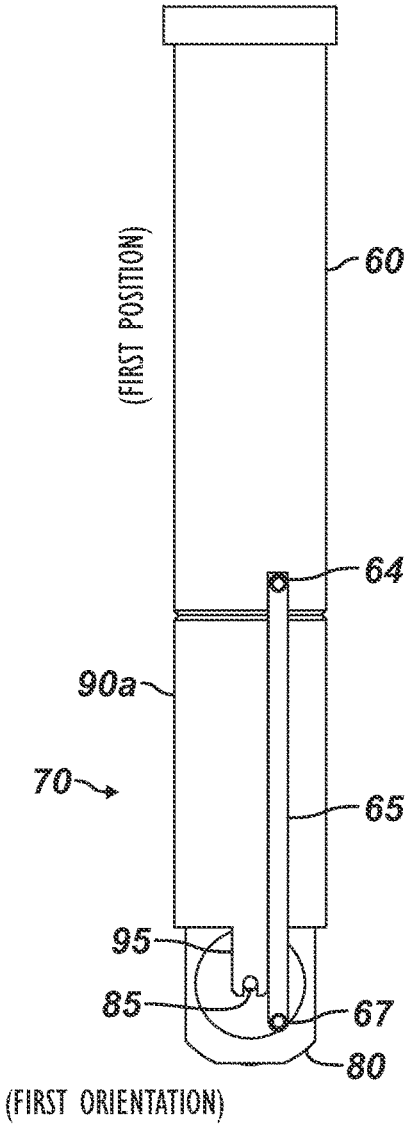
FIGS. 3A-3B illustrate internal components of the revolving ball seat in the run-in condition and the actuated condition, respectively, having one type of operable connection.
Figure 3B:
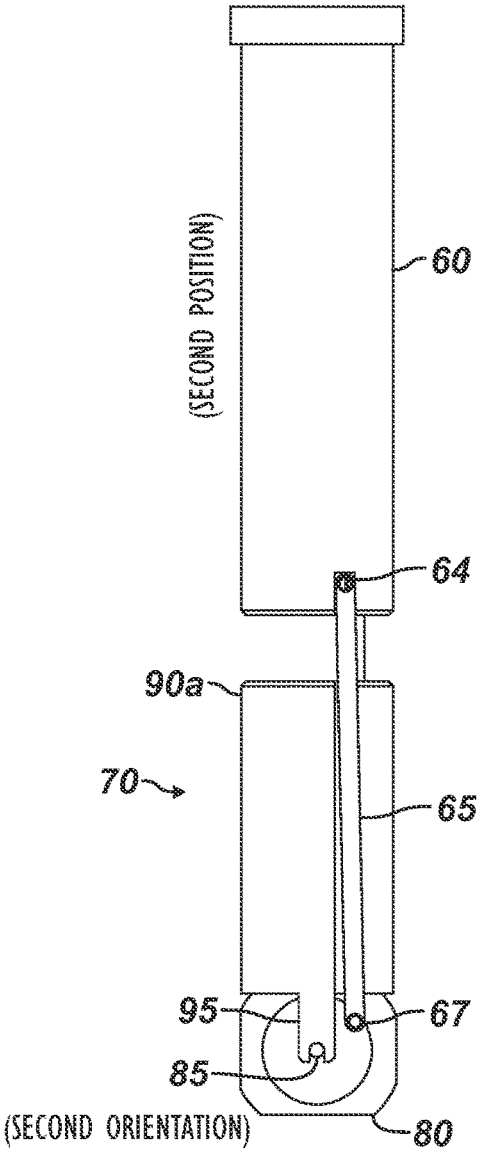

The first mandrel 90*a* is aligned with the piston 60 and has the seat 80 rotatably connected thereto. For example, FIG. 3A illustrates internal components of the revolving ball seat 80 and related components in the run-in condition, and FIG. 3B illustrates the internal components in the actuated condition. As shown, segments or legs 95 of the first mandrel 90*a* extend on the sides of the seat 80 and rotatably connect to rotation points or axles 85 on the sides of the seat 80 about which the seat 80 can rotate.

As again shown in FIG. 2A, the second mandrel 90*b* is also aligned with the piston 60 and has the seat 80 rotatably supported thereon. The second mandrel 90*b* may or may not be connected to the first mandrel 90*a* and may or may not have legs as with the first mandrel 90*a*. Overall, the seat 80 may rest supported against the top of the second mandrel 90*b*. Other configurations can be used as will be appreciated.

Internal features of the seat 80 are shown in FIGS. 2A-2C, and some of the external features of the seat 80 are shown FIGS. 3A-3B. The seat 80 is a spherical body and defines passages 81 and 83 therethrough. On either side of the spherical body, the seat 80 has the axles 85 or points of rotation about which the seat 80 is arranged to rotate.

The piston 60 having the operable connection 65 operably couples to the seat 80. As shown in FIGS. 3A-3B, for example, the operable connection 65 can be a linkage that connects with one hinged connection 64 to the piston 60 and connects with another hinged connection 67 to the seat 80. This second hinged connection 67 is eccentric to the axles 85 of rotation of the seat 80 connected to the first mandrel 90*a*.

As can be surmised from the arrangement, movement of the piston 60 in one direction away from the catch 70 rotates the seat 80 around its axis, while movement of the pistons 60 and catch 70 in unison with one another does not cause the seat 80 to rotate. Therefore, as shown in FIG. 3B, the piston 60 moved away from the upper mandrel 90*a* pulls the linkage 65. As the piston 60 travels away from the seat 80, the linkage 65 then rotates the seat 80 about 90-degrees. Although one side is shown, the opposite side could have a comparable arrangement of linkage 65, hinged connection 67, leg 95, etc.

As indicated above, axial movement of the first connection 64 on the piston 60 moved away from the catch 70 and the seat 80 is transferred into rotational motion for rotating the seat 80 on the catch 70. Mechanisms other than a linkage can be used to transfer the axial movement of the piston 60 away from the catch 70 into rotational motion for rotating the seat 80 on the catch 70. For example, other than a linkage, the operable connection 65 between the piston 60 and the seat 80 can use rack and pinion gears, lever, cam, and the like. Some of these are disclosed below.

As for the passages of the seat 80, a first passage 81 has an opening for entry of the deployed ball B from the catch's axial bore 72 and has an opposite seat profile 82 for engaging the deployed ball B. When the seat 80 is in the first orientation (FIG. 2A), the ball B can pass through the catch's bore 72, enter through the opening of the first passage 81, and land in the seat profile 82. When pressure is communicated against the seated ball B, the ball B can remain engaged in the seat profile 82.

A second passage 83 of the seat 80 is offset (e.g., orthogonal) to the first passage 81. As shown in FIG. 2C, this second passage 83 aligns with the catch's axial bore 72 when the seat 80 has the second (rotated) orientation. Preferably, the second passage 83 defines an equivalent inner dimension to the catch's axial bore 72. Similarly, the catch's axial bore 72 preferably defines an equivalent inner dimension to the piston's axial bore 62. In this way, the tool 50 can have a consistent main bore for passage of other tools, tubulars, coiled tubing, wireline, etc.

Operation of the tool 50 is shown in FIGS. 2A-2C. As noted above, the tool 50 is shown set in a run-in position in FIG. 2A. A ball B has been dropped to land on the ball seat profile 82 inside the ball seat's passage 81. The seat 80 engaging the deployed ball B holds fluid pressure in the housing 52. With the ball B seated, operators can pressure up the wellbore tubing uphole of the seat 80 to the required pressure to actuate any hydraulically actuated tools (20: FIG. 1).

Once such tools (20) are actuated or even before, pressure can be used to actuate the downhole tool 50. The pressure uphole of the seated ball B acts against the seated ball B and eventually shears the temporary connections 94. Conventional shear pins or other temporary connections can be used to initially hold the catch 70 (and concurrently the piston 60) in their run-in position (FIG. 2A) and can subsequently break once the required pressure level is reached (FIG. 2B). Several options are available for holding the catch 70.

As shown in FIG. 2A, the second mandrel 90*b* has the connections 94 at least temporarily holding the catch 70 axially in the bore 54 of the housing 52. The connections 94 release the catch 70 to move axially in response to fluid pressure communicated in the bore 54 against the deployed ball B engaged in the seat 80 in the first orientation. Although the one or more shear pins 94 or other temporary connections can affix the lower mandrel 90*b* of the catch 70 in the housing 52, shear pins and the like can be used elsewhere on the assembly.

With the catch 70 and piston 60 free to move in the housing 54, the applied pressure against the ball B in the seat 80 moves the piston 60 and catch 70 together in the housing's bore 54 until the catch 70 shoulders out in the bore 54, as shown in FIG. 2B.

As then shown in FIG. 2B, the second mandrel 90*b* has a stop or lock 96 that holds the catch 70 axially in the bore of the housing 52 after the catch 70 has moved axially in the bore 54 once released. This lock 96 can be an expandable lock ring or C-ring disposed on the second mandrel 90*b* that expands into a surrounding profile or groove on the housing's bore 54 when the second mandrel 90*b* moves axially to its downward position. Other forms of locking can be used.

With the second mandrel 90*b* locked in place, fluid can bypass the seat 80 to equalize the pressure above and below the seat 80. The equalization is possible due to the movement of the O-ring seal 97 reaching the increased dimension inside the housing's bore 54 when the lock ring 96 engages an internal shoulder of the bore 54. Fluid uphole of the seat 80 can pass through the annular space between the second mandrel 90*b* and the housing's bore 54 to downhole the seat 80.

The above pressure equalization is not strictly required for operation of the tool 50. Instead, the O-ring seal 97 may remain engaged and sealed in the housing's bore 54 by either being positioned elsewhere on the mandrel 90*b* (i.e., uphole of the lock ring 96) or by keeping the O-ring seal 97 in its shown position and maintaining the bore 54's dimension with a discrete groove for the lock ring 96).

Once operations are complete, pressure buildup in the tool 50 is diminished either through the pressure equalization described above, by purposeful decrease of the pressure at the surface, and/or by some other release. The spring 66 forces the piston 60 away from the catch 70, which remains held in place as shown in FIG. 2C. The piston 60 moves from the first position near the catch 70 to the second position away from the catch 70 in response to a reduction of the communicated fluid pressure. The linear movement of the piston 60 is transmitted to the revolving ball seat 80 through the linkage 65 so that the movement of the piston 60 away from the catch 70 rotates the seat 80 from the first orientation to the second orientation.

Because pressure has pushed the ball B against the seat profile 82 and the ball B is sized to fit inside the seat's outer diameter, the ball B may rotate with the seat 80 without wedging against the mandrel 52, catch 70, or other component. If the ball B is loose in the seat 82 to an extent, then the size of the ball B, the seat profile 82, offset bore 83, etc. may be configured to prevent trapping or wedging of the ball B. Either way, with the ball seat 80 rotated, the ball B is exposed to the throughbore of the tool 50, and the ball B is free to pass through the tool 50. At this point, other operations can be performed through the tool 50 without the constriction of the seat 50.

Figure 4A:
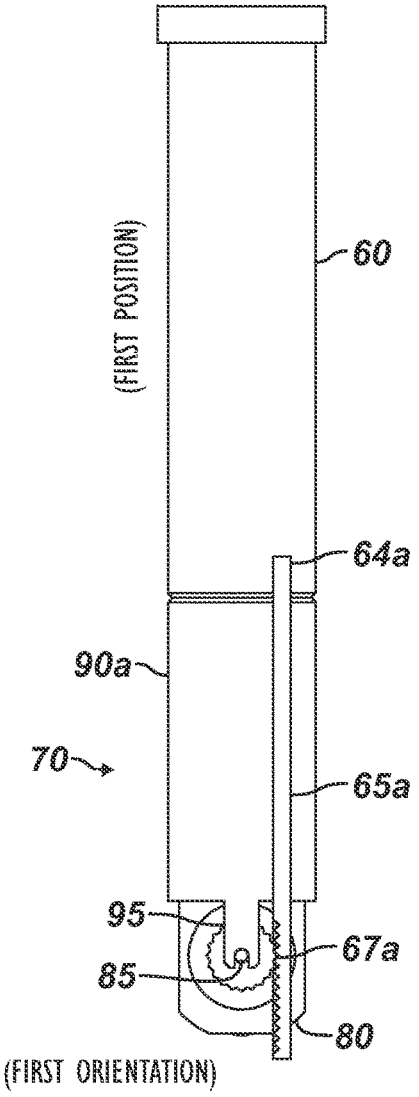
FIGS. 4A-4B illustrate internal components of the revolving ball seat in the run-in condition and the actuated condition, respectively, having another operable connection.
Figure 4B:
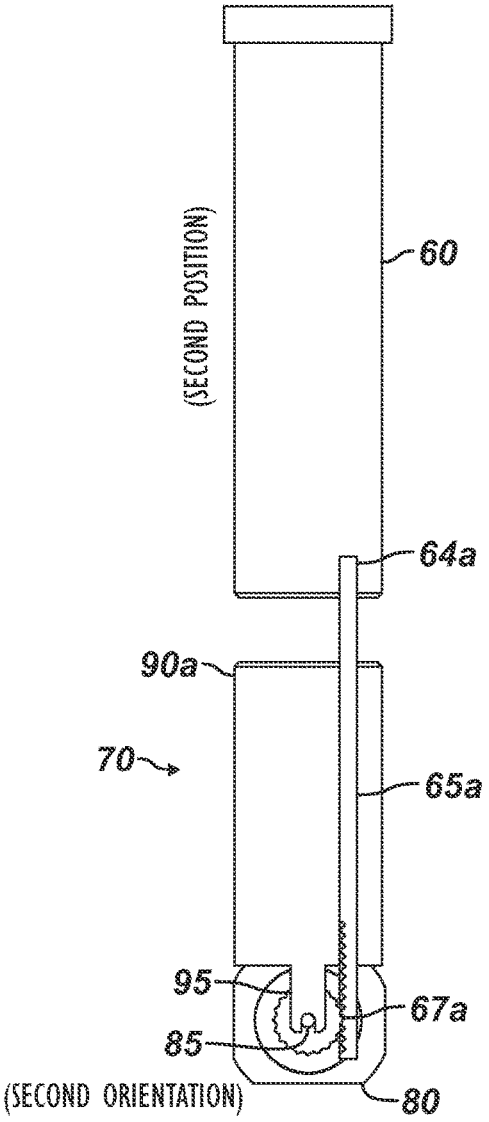

Previous embodiments have discussed using a pivotable linkage as the operable connection 65 between the piston 60 and the revolving ball seat 80. As discussed herein, alternative forms of operable connections can be used. For example, FIGS. 4A-4B illustrate internal components having another arrangement in the run-in condition and the actuated condition, respectively. Here, the operable connection 65*a* is an arm that connects with a fixed point 64*a* on the piston 60 and couples with a rack and pinion arrangement 67*a* to the seat 80.

As can be surmised from the arrangement, movement of the piston 60 in one direction away from the catch 70 rotates the seat 80 in one direction around its axis 85, while movement of the pistons 60 and catch 70 in unison with one another would not cause the seat 80 to rotate. Therefore, as shown in FIG. 4B, the piston 60 moved away from the upper mandrel 90*a* pulls the arm 65*a*. As the piston 60 travels away from the seat 80, the rack and pinion arrangement 67*a* then rotates the ball seat 80 about 90-degrees. Although one side is shown, the opposite side could have a comparable arrangement.

Figure 5A:
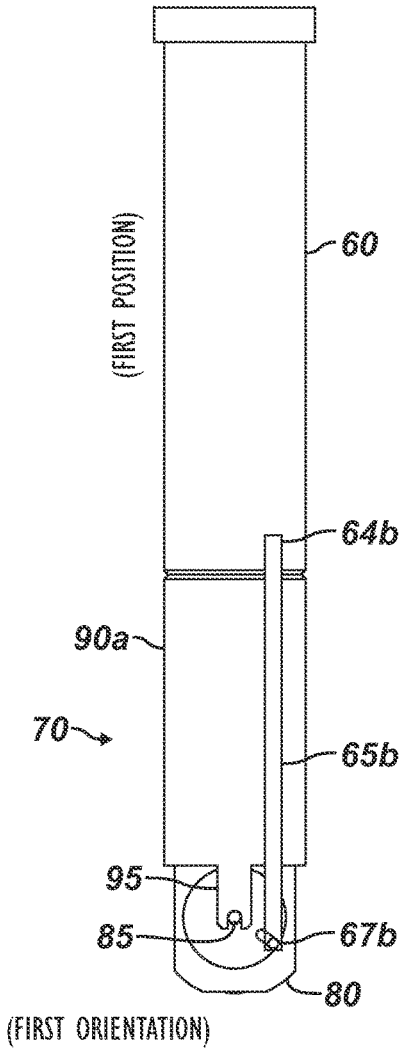
FIGS. 5A-5B illustrate internal components of the revolving ball seat in the run-in condition and the actuated condition, respectively, having yet another operable connection.
Figure 5B:
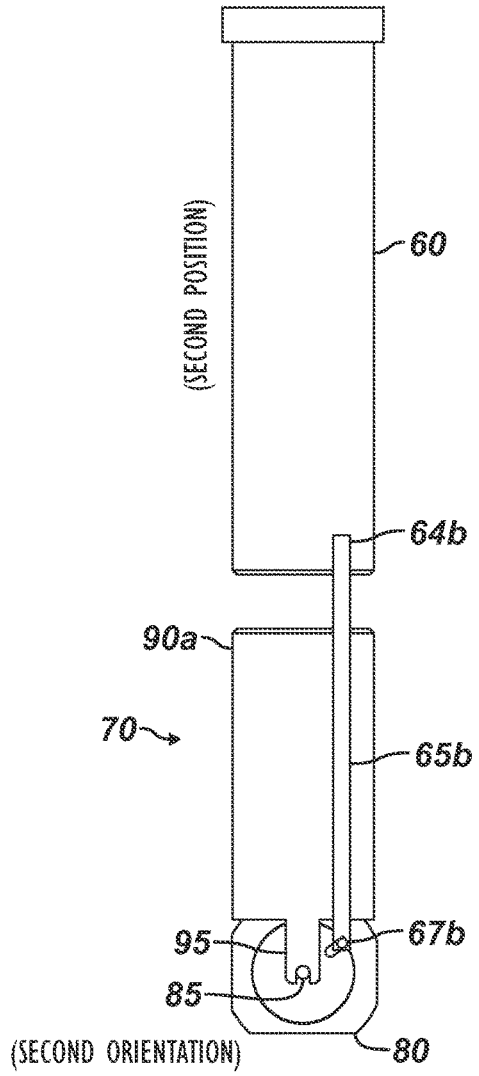

In another example, FIGS. 5A-5B illustrate internal components having another arrangement in the run-in condition and the actuated condition, respectively. The operable connection 65*b* is an arm that connects with a fixed point 64*b* on the piston 60 and couples with a pin and slot arrangement 67*b* to the seat 80. As can be surmised from the arrangement, movement of the piston 60 in one direction away from the catch 70 rotates the seat 80 around its axis 85, while movement of the pistons 60 and catch 70 in unison with one another would not cause the seat 80 to rotate. Therefore, as shown in FIG. 4B, the piston 60 moved away from the upper mandrel 90*a* pulls the arm 65*b*. As the piston 60 travels away from the seat 80, the pin and slot arrangement 67*b* then rotates the ball seat 80 about 90-degrees. Although one side is shown, the opposite side could have a comparable arrangement.

Previous embodiments have discussed using the revolving ball seat 80 in a downhole tool 50 that is separate from any hydraulically-actuated tool (20: FIG. 1) disposed on a wellbore tubular (12). In other embodiments, the revolving ball seat 80 can actually be incorporated into a hydraulically-actuated tool, such as a packer, a liner hanger, or the like. In fact, the revolving ball seat 80 can actually be used directly as a part of the hydraulic actuating mechanism of such a tool.

Figure 6A:
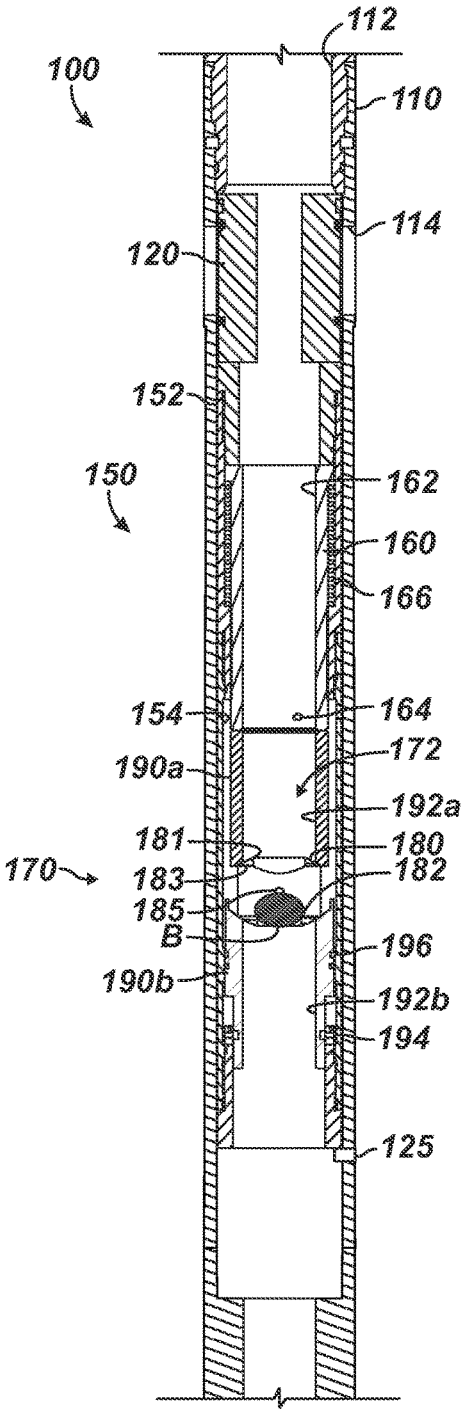
FIGS. 6A-6B illustrate cross-sectional views of a sliding sleeve in closed and opened conditions having a revolving ball seat assembly according to the present disclosure.
Figure 6B:
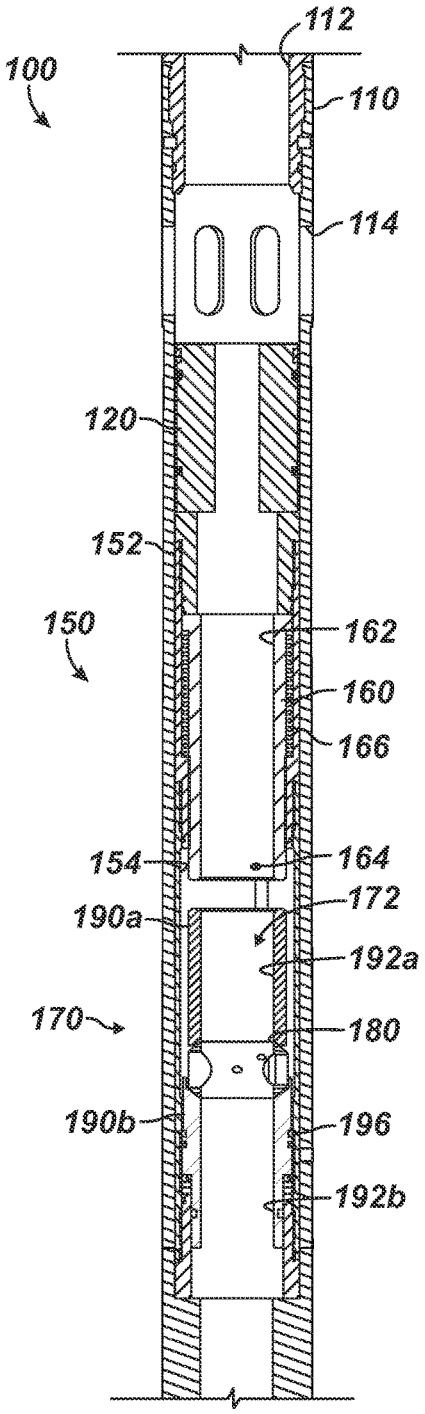

As one particular example, a sliding sleeve can incorporate the revolving ball seat as part of its mechanism for hydraulically opening the sliding sleeve for fracture treatments or other operations. FIGS. 6A-6B show a sliding sleeve 100 in closed and opened states. The sliding sleeve 100 has a tool body 110 defining one or more ports 114 communicating the body's main bore 112 outside the sleeve 100. An inner sleeve 120 disposed in the tool's bore 112 covers the ports 114 when the inner sleeve 120 is in a closed condition, as shown in FIG. 6A.

A dropped ball B engages in a revolving ball seat assembly 150 that is incorporated into the inner sleeve 120. Thus, as shown, the revolving ball seat assembly 150 is similar to that disclosed above and has a housing 152, a piston 160, a catch 170, and a seat 180, which are all incorporated into or part of the inner sleeve 120 movably disposed in the main bore 112 of the sleeve's body 110. In general, the assembly's housing 52 can be connected to or part of the inner sleeve 120.

Pressure applied against the seated ball B eventually shears a set of first shear pins 125 or other temporary connections that hold the inner sleeve 120 in the housing's bore 112. Now free to move, the inner sleeve 120 moves with the applied pressure in the bore 112 and exposes the housings ports 114, as shown in FIG. 4B. Fluid treatment can then be performed to the annulus surrounding the sliding sleeve 100.

When it is then desired to open the revolving ball seat assembly 150, additional pressure applied against the seated ball B, such as during a fracture treatment, can act against the seated ball B. Eventually, when a predetermined pressure level is reached, one or more shear pins 194 or other breakable connections can break so that the applied pressure moves the piston 160 and catch 170 of the assembly 150 in unison downward in the sleeve 120. Then, when pressure is diminished, the piston 160 of the assembly 150 can move away from the catch 170 and rotate the ball seat 180 to release the ball B.

In the above discussion, the shear pins 125 holding the sleeve 120 have a lower pressure setting than the shear pins 194 holding the catch 170. This allows the sleeve 120 to open with pressure applied against the seat 180 while the seat's catch 170 remains in its initial state. Eventual pressure can then break the shear pins 194 for the catch 170.

A reverse arrangement of the activation can also be used. For example, a ball B can be dropped to the seat 180 and applied pressure can shear the shear pins 194 so the piston 160 and catch 170 are free to move in unison. Then, when pressure builds to a sufficient level, the shear pins 125 of the sleeve 120 can eventually break, allowing the sleeve 120 to shift open.

Figure 7A:
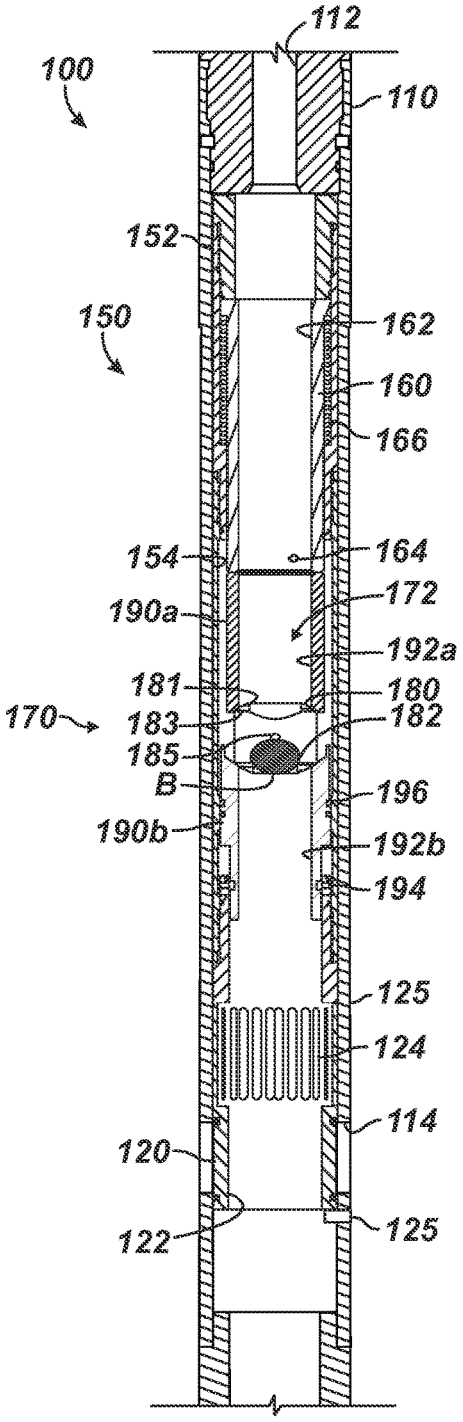
FIGS. 7A-7B illustrate cross-sectional views of another sliding sleeve in closed and opened conditions having a revolving ball seat assembly according to the present disclosure.
Figure 7B:
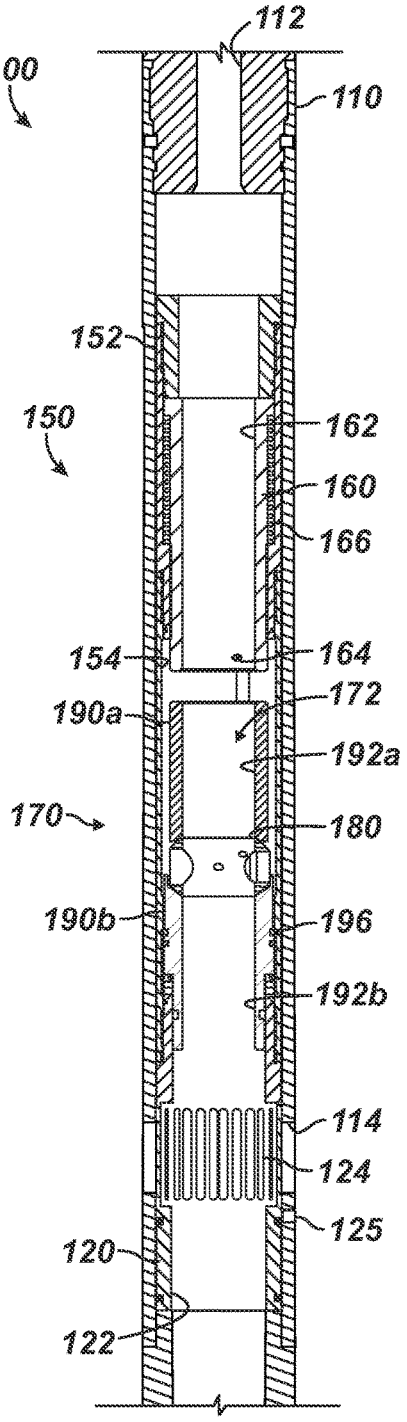

Although the external ports 114 for the sliding sleeve 100 are disposed uphole of the revolving ball seat assembly 150 in FIGS. 6A-6B, an opposite arrangement can be provided, as shown in FIGS. 7A-7B. Here, the inner sleeve 120 has slots 124 that align with the housing ports 114 disposed downhole from the seat 180 when the inner sleeve 120 is moved downhole in the tool's housing 110. The other components of this configuration can be essentially the same as those described previously.

In the arrangement of FIGS. 2A-2C, the shear pins 94 or other temporary connections are used between the catch's lower mandrel 90*b* and the housing 52. Other arrangements can be used. In one additional option, the catch 70 and the piston 60 may be interconnected to one another by shear pins or other temporary connections so that they are forced to move together.

Figures 8A, 8B, 8C:
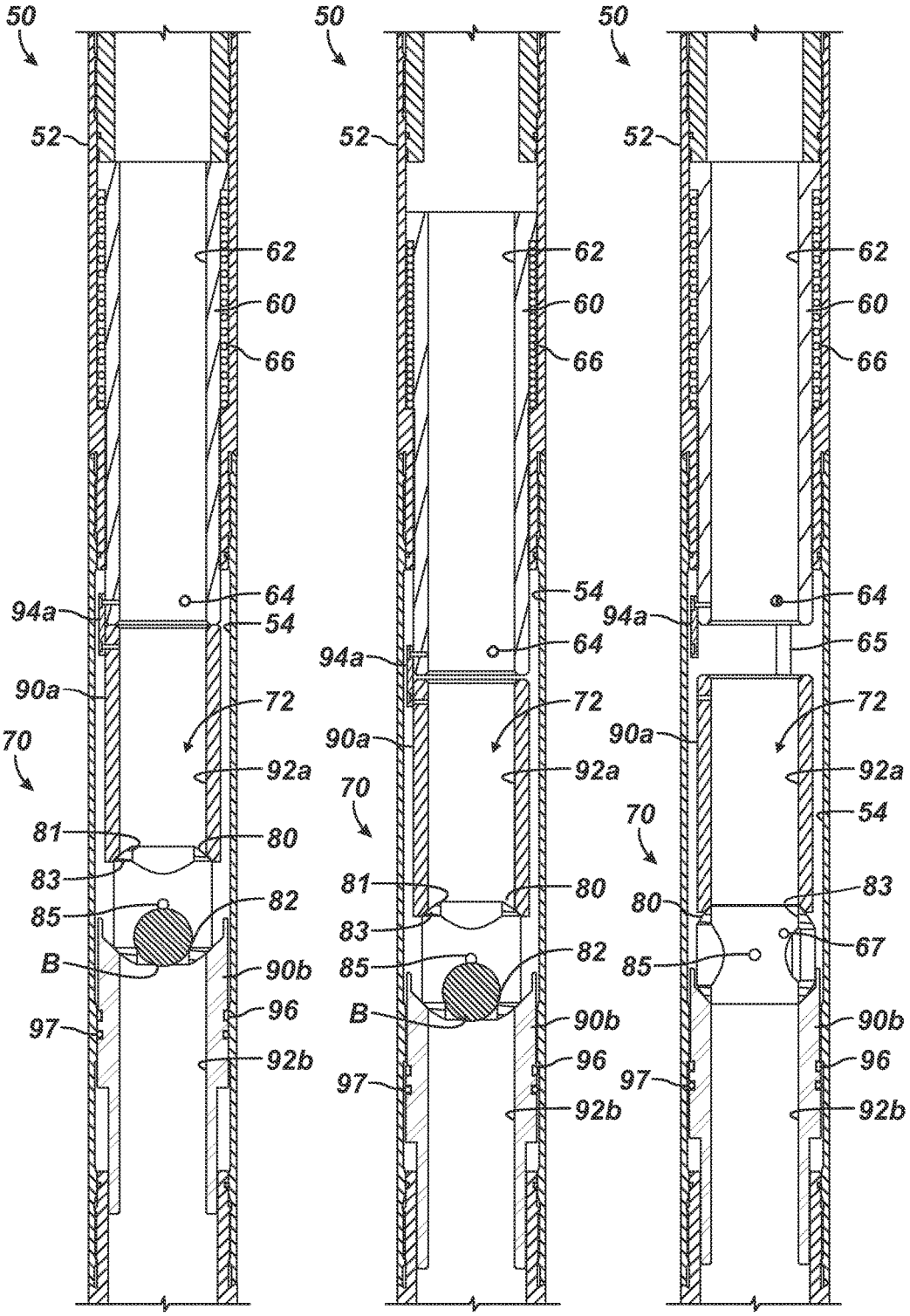
FIGS. 8A-8C illustrate cross-sectional views of another downhole tool having a revolving ball seat according to the present disclosure in run-in, intermediate, and actuated conditions.

As shown in FIGS. 8A-8C, cross-sectional views of another downhole tool 50 having a revolving ball seat according to the present disclosure is shown in run-in, intermediate, and actuated conditions. Many features of this tool 50 are the same as discussed above so that like reference numerals are used. As shown here, rather than having a temporary connection or shear pins temporary holding the catch 70 (esp. the lower mandrel 90*b*) in the bore 54 of the housing 52, a temporary connection 94*a* instead temporarily holds the piston 60 and the catch 70 together to move jointly together.

As shown in FIG. 8A, a ball B engages in the seat 80 as before. Fluid pressure applied against the ball B engaged in the seat 80 jointly moves the piston 60 and catch 70. In this joined movement and as shown in FIG. 8B, the piston 60 may then shoulder out in the housing 52 before the catch 70 shoulders out. Therefore, with the ball B seated in the seat 80, communicated pressure can shift the piston 60 and catch 70 together against the bias of the spring 66. Eventually, the piston 60 shoulders out inside the housing 52, while the catch 70 does not. When the communicated pressure acting against the seat 80 reaches a shear level of the temporary connection 94*a*, the catch 70 can shear free as it is moved away from the piston 60.

The catch 70 can then lock in a downward position with the lock ring 96. In one option, the ball seat 80 can rotate as the catch 70 is allowed to continually move away from the shouldered piston 70. Alternatively or in addition to this, another option can use the bias of a spring 66 as before to move the piston 60 away from the held catch 70 to rotate the seat 80 and release the ball B. This and other arrangements can be suitable for certain implementations.

The foregoing description of preferred and other embodiments is not intended to limit or restrict the scope or applicability of the inventive concepts conceived of by the Applicants. Although reference to use of a ball B has been used throughout the disclosure, it will be appreciated that a setting ball, a deployed device, or other type of "plug" can be used. Although the tool 100 of FIGS. 6A-6B and 7A-7B has been disclosed as a sliding sleeve having an inner sleeve 120 movable relative to ports 114, it will be appreciated that the tool 100 could be any other type of tool, such as a hydraulically actuated tool, a packer, a liner hanger, etc. with the sleeve 120 constituting a piston or other hydraulic mechanism actuating a component, such as a slip, a packer, etc. Alternatively, the sleeve 120 can move to expose an internal port of the tool, through which fluid pressure can communicate with a hydraulic mechanism.

It will also be appreciated with the benefit of the present disclosure that features described above in accordance with any embodiment or aspect of the disclosed subject matter can be utilized, either alone or in combination, with any other described feature, in any other embodiment or aspect of the disclosed subject matter.

In exchange for disclosing the inventive concepts contained herein, the Applicants desire all patent rights afforded by the appended claims. Therefore, it is intended that the appended claims include all modifications and alterations to the full extent that they come within the scope of the following claims or the equivalents thereof.

What is claimed is:

1. A downhole apparatus for use with a deployed plug and applied fluid pressure, the apparatus comprising:

a housing defining a bore;

a piston disposed in the bore of the housing and biased to move from a first position to a second position; and a seat disposed in the bore of the housing and operably connected to the piston, the seat rotatable from a first orientation for engaging the deployed plug to a second orientation for passing the deployed plug in response to movement of the piston from the first position near the seat to the second position away from the seat, the seat in the first orientation with the deployed plug engaged therein capturing at least some of the applied fluid pressure, an operable connection of the piston to the seat and transferring axial movement of the piston away from the seat to rotational movement of the seat, the operable connection comprising a linkage operably coupled between the piston and the seat, the linkage on the piston moved from the first position near the seat to the second position away from the seat rotating the seat from the first orientation to the second orientation.

2. The apparatus of claim 1, comprising at least one biasing member disposed in the housing and biasing the piston toward the second position away from the seat.

3. The apparatus of claim 1, wherein the seat comprises a first section aligned with the piston and having the seat rotatably supported thereon.

4. The apparatus of claim 3 wherein the first section comprises at least one segment rotatably connected to a rotation point on the seat.

5. The apparatus of claim 3, wherein the seat comprises a second section aligned with the piston and having the seat rotatably supported thereon.

6. The apparatus of claim 5, wherein the second section comprises a connection at least temporarily holding the seat axially in the bore of the housing, the connection releasing the seat to move axially in response to the applied fluid pressure communicated in the bore against the deployed plug engaged in the seat in the first orientation.

7. The apparatus of claim 6, wherein the second section comprises a lock holding the seat axially in the bore of the housing after the seat has moved axially in the bore once released.

8. The apparatus of claim 1, wherein the piston comprises a first sleeve disposed in the bore of the housing and defining a first axial bore therethrough.

9. The apparatus of claim 8, wherein the seat comprises a second sleeve defining a second axial bore therethrough in line with the first axial bore of the piston.

10. The apparatus of claim 9, wherein the seat comprises a body rotatably supported on the second sleeve, the body having a first passage with an opening for entry of the deployed ball from the second axial bore and with an opposite seat profile for engaging the deployed ball.

11. The apparatus of claim 10, wherein the body has a second passage offset from the first passage and aligning with the second axial bore when the seat has the second orientation.

12. The apparatus of claim 11, wherein the second passage defines an equivalent inner dimension to the second axial bore.

13. The apparatus of claim 12, wherein the second axial bore defines an equivalent inner dimension to the first axial bore.

14. The apparatus of claim 1, wherein the apparatus is selected from the group consisting of a hydraulically-actuated tool, a sliding sleeve, a packer, and a liner hanger.

15. The apparatus of claim 1, further comprising:

a tool positionable on a toolstring uphole of the seat and actuatable with at least some of the applied fluid pressure captured in the toolstring with the seat.

16. A downhole apparatus for use with a deployed plug and applied fluid pressure, the apparatus comprising:

a housing defining a bore;

a piston disposed in the bore of the housing and biased to move from a first position to a second position;

a seat disposed in the bore of the housing and operably connected to the piston, the seat rotatable from a first orientation for engaging the deployed plug to a second orientation for passing the deployed plug in response to movement of the piston from the first position near the seat to the second position away from the seat, the seat in the first orientation with the deployed plug engaged therein capturing at least some of the applied fluid pressure; and a connection at least temporarily holding the seat axially in the bore of the housing, the connection releasing the seat in response to the applied fluid pressure communicated in the bore against the deployed plug engaged in the seat in the first orientation.

17. The apparatus of claim 16, wherein the piston comprises an operable connection to the seat, the operable connection transferring axial movement of the piston away from the seat to rotational movement of the seat.

18. The apparatus of claim 17, wherein the operable connection comprises a linkage operably coupled between the piston and the seat, the linkage on the piston moved from the first position near the seat to the second position away from the seat rotating the seat from the first orientation to the second orientation.

19. The apparatus of claim 16, wherein the piston moves from the first position near the seat to the second position away from the seat in response to a reduction of the applied fluid pressure, and wherein the movement of the piston away from the seat rotates the seat from the first orientation to the second orientation.

20. The apparatus of claim 16, wherein the seat comprises a lock holding the seat axially in the bore of the housing after the seat has moved axially in the bore once released.

21. The apparatus of claim 16, comprising at least one biasing member disposed in the housing and biasing the piston toward the second position away from the seat.

22. The apparatus of claim 16, further comprising a tool positionable on a toolstring uphole of the seat and actuatable with at least some of the applied fluid pressure captured in the toolstring with the seat.

23. The apparatus of claim 16, wherein the apparatus is selected from the group consisting of a hydraulically-actuated tool, a sliding sleeve, a packer, and a liner hanger.

24. The apparatus of claim 16, wherein the seat comprises a first section aligned with the piston and having the seat rotatably supported thereon; and wherein the seat comprises a second section aligned with the piston and having the seat rotatably supported thereon.

25. The apparatus of claim 16, wherein the piston comprises a first sleeve disposed in the bore of the housing and defining a first axial bore therethrough, and wherein the seat comprises:

a second sleeve defining a second axial bore therethrough in line with the first axial bore of the piston, and a body rotatably supported on the second sleeve, the body having a first passage with an opening for entry of the deployed ball from the second axial bore and with an opposite seat profile for engaging the deployed ball.

26. The apparatus of claim 16, comprising a tool body having a main bore in which the housing is movably disposed, the tool body defining a port communicating with the main bore, and wherein the housing is movable in the tool body relative to the port.

27. A downhole apparatus for use with a deployed plug and applied fluid pressure, the apparatus comprising:

a housing defining a bore;

a piston disposed in the bore of the housing and biased to move from a first position to a second position;

a seat disposed in the bore of the housing and operably connected to the piston, the seat rotatable from a first orientation for engaging the deployed plug to a second orientation for passing the deployed plug in response to movement of the piston from the first position near the seat to the second position away from the seat, the seat in the first orientation with the deployed plug engaged therein capturing at least some of the applied fluid pressure; and a tool body having a main bore in which the housing is movably disposed, the tool body defining a port communicating with the main bore, and wherein the housing is movable in the tool body relative to the port.

28. The apparatus of claim 27, further comprising a connection at least temporarily holding the housing in the main bore of the tool body.

29. The apparatus of claim 27, wherein the piston comprises an operable connection to the seat, the operable connection transferring axial movement of the piston away from the seat to rotational movement of the seat.

30. The apparatus of claim 29, wherein the operable connection comprises a linkage operably coupled between the piston and the seat, the linkage on the piston moved from the first position near the seat to the second position away from the seat rotating the seat from the first orientation to the second orientation.

31. The apparatus of claim 27, comprising at least one biasing member disposed in the housing and biasing the piston toward the second position away from the seat.

32. The apparatus of claim 27, wherein the seat comprises a first section aligned with the piston and having the seat rotatably supported thereon; and wherein the seat comprises a second section aligned with the piston and having the seat rotatably supported thereon.

33. The apparatus of claim 27, wherein the piston comprises a first sleeve disposed in the bore of the housing and defining a first axial bore therethrough, and wherein the seat comprises:

a second sleeve defining a second axial bore therethrough in line with the first axial bore of the piston, and a body rotatably supported on the second sleeve, the body having a first passage with an opening for entry of the deployed ball from the second axial bore and with an opposite seat profile for engaging the deployed ball.

34. A method of operating a downhole tool with a deployed plug and applied fluid pressure, the method comprising:

engaging the deployed plug in a seat rotated in a first orientation in a bore of the tool;

moving the seat engaging the deployed plug and moving a piston operably coupled to the seat in response to the applied fluid pressure;

moving the piston away from the seat in response to subsequent reduction of the applied fluid pressure;

rotating the seat from the first orientation to a second orientation in response to the movement of the piston away from the seat; and releasing the engaged plug from the seat in response to the rotation of the seat to the second orientation.

35. The method of claim 34, wherein moving the seat engaging the deployed plug and moving the piston operably coupled to the seat in response to the applied fluid pressure comprises releasing a temporary hold of the seat and the piston in response to the applied fluid pressure.

36. The method of claim 34, wherein moving the piston away from the seat comprises locking the seat axially in the tool.

37. The method of claim 34, wherein moving the piston away from the seat comprises biasing the piston in a direction away from the seat.

38. The method of claim 34, wherein engaging the deployed plug in the seat rotated in the first orientation in the bore of the tool comprises actuating the tool in response to the applied fluid pressure against the deployed plug engaged in the seat.

39. The method of claim 38, wherein actuating the tool in response to the applied fluid pressure against the deployed plug engaged in the seat comprises shifting a sleeve relative to a port in the tool.

40. The method of claim 34, wherein engaging the deployed plug in the seat rotated in the first orientation in the bore of the tool comprises actuating another tool in response to the applied fluid pressure against the deployed plug engaged in the seat.

41. The method of claim 34, wherein actuating the other tool comprises actuating at least one of a hydraulically-actuated tool, a sliding sleeve, a packer, and a liner hanger.

* * * * *